US007726072B1

(12) United States Patent
Kuslaka et al.

(10) Patent No.: US 7,726,072 B1
(45) Date of Patent: Jun. 1, 2010

(54) ADJUSTABLE PLANT HANGER

(76) Inventors: Sharon A Kuslaka, 7 Crestwood Ct., Amherst, NH (US) 03031; Jennifer Lavoie, 8 Falcon Rd., Londonderry, NH (US) 03053

( * ) Notice: Subject to any disclaimer, the term of this patent is extended or adjusted under 35 U.S.C. 154(b) by 0 days.

(21) Appl. No.: 12/362,800

(22) Filed: Jan. 30, 2009

Related U.S. Application Data

(60) Provisional application No. 61/063,142, filed on Feb. 1, 2008.

(51) Int. Cl.
*A47G 7/02* (2006.01)

(52) U.S. Cl. ..... 47/67

(58) Field of Classification Search ..... 47/67; D6/514

See application file for complete search history.

(56) References Cited

U.S. PATENT DOCUMENTS 2,064,826 A * 12/1936 Gabriel ..... 220/660
D240,383 S * 7/1976 Connell ..... D6/513
4,057,210 A * 11/1977 Wellman ..... 248/318
D256,412 S * 8/1980 Hovanec ..... D6/514
4,337,916 A * 7/1982 Norris ..... 248/558
4,349,172 A * 9/1982 Banks, Jr. ..... 248/318
5,360,193 A * 11/1994 Cobb ..... 248/318
6,062,520 A * 5/2000 Ralston et al. ..... 248/318
6,748,727 B1 * 6/2004 Schulte ..... 54/47
2006/0277824 A1 * 12/2006 Clair ..... 47/67

* cited by examiner

*Primary Examiner*—Francis T Palo
(74) *Attorney, Agent, or Firm*—Joseph E. Funk

(57) ABSTRACT

An adjustable plant hanger is disclosed having straps that support a pot in which plants are placed. The straps comprise two or more loops that are not fastened to a ring by which the plant hanger may be hung from an overhead hook. The loop straps pass through the adjustable element or sleeve which can slide up and down along the straps to make it easier to mount a larger pot inside the straps of the plant hanger, making it easier to level pot and adjust when needed. The adjustable element is also adjusted vertically to more safely hold pots of different sizes. The straps are connected to a support element located beneath a pot. The spacing element maintains the straps are spaced around the sides of a pot evenly in the plant hanger to assure that the pot will not easily fall from the hanger. The straps may be individually slid through the ring and adjustable element to level an irregular shaped or larger pot held in the plant hanger.

7 Claims, 3 Drawing Sheets

ADJUSTABLE PLANT HANGER

RELATED APPLICATION

This utility patent application claims benefit under U.S. Provisional Patent Application No. 61/063,142, entitled Adjustable Plant Hanger, filed on Feb. 1, 2008.

FIELD OF THE INVENTION

The invention relates to plant hangers and more particularly to a decorative hanger for suspending a plant container from an overhead support that has an adjustable element or sleeve and elongated straps for placing a pot in the plant hanger, and for leveling the pot for safety purposes and for aesthetics of displaying the pot.

BACKGROUND OF THE INVENTION

Plant hangers having elongated members in the form of straps for suspending a plant in a pot from an overhead support are in wide use. However, such plant hangers are typically fixed in their physical configuration during the manufacturing process and it is sometimes difficult to insert a pot into the plant hanger. In addition, after a pot is inserted into and is hanging inside the plant hanger the pot may not be level and there is no simple way to facilitate leveling the pot. Further, there is typically no way to adjust the plant hanger and to change the aesthetic appearance of the plant hanger as desired by the person installing the plant hanger. Finally, there are no means provided to that a pot will be held safely inside the plant hanger.

Thus, there is a need in the art for a new type of plant hanger that a user can adjust to make it easier to insert a pot and that the user can adjust to easily level a pot in the plant hanger, that will assure that a pot will be held safely inside the plant hanger, and that the user can adjust to change the aesthetic appearance of the plant hanger.

SUMMARY OF THE INVENTION

The aforementioned need in the prior art is satisfied by the present invention. A novel, adjustable plant hanger is taught that has a manually adjustable element or sleeve around the straps of the plant hanger that is moved up and down to permit easier insertion of larger pots into the plant hanger.

A spacing element is attached to the straps of the plant hanger where they meet at the bottom of the plant hanger and the bottom of a pot would be placed. The spacing element keeps the straps equally spaced so that the straps will be generally equally spaced around the sides of a pot held inside the plant hanger. This assures that the straps will be evenly distributed around the pot and that the pot held therein cannot easily fall from the plant hanger.

The straps used in the plant hanger are looped through the opening of the top ring and are not fastened to the ring of the plant hanger that is used to hang the plant hanger with a plant therein from an overhead hook. Rather, the straps loop through the top ring and under a pot held in the plant hanger. Each of the looped straps of the plant hanger can easily be adjusted through the top ring, allowing the manually adjustable element or sleeve to level a pot held in the plant hanger. By placing a pot in the hanger, the user can push down on the pot which will self adjust straps to be level and safe.

The manually adjustable element around the straps nearer to the ring by which the plant hanger is hung from a hook can be slid up and down along the looped straps after a pot with plant is positioned inside the plant hanger. The final position of the manually adjustable element or sleeve is determined by a user installing the plant hanger with pot and plant therein to adjust the aesthetic appearance of the plant hanger to their individual taste. The manually adjustable element can be positioned adjacent to the top ring, as close to the pot and plant as possible, or anywhere in between.

BRIEF DESCRIPTION OF THE DRAWINGS

The invention will be better understood upon reading the following detailed description in conjunction with the drawing in which.

DETAILED DESCRIPTION

Figure 1:
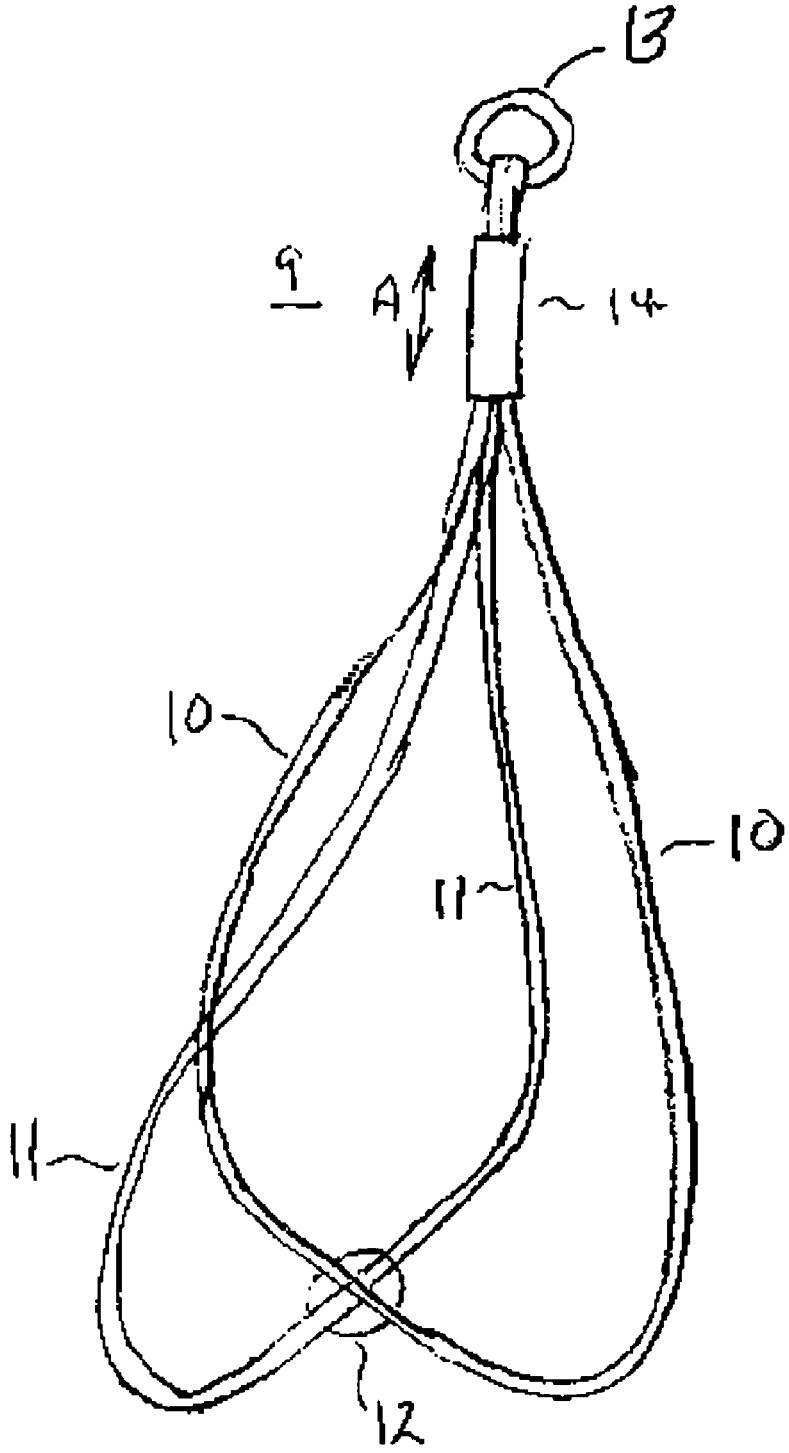
FIG. 1 shows the novel plant hanger with no pot held therein.
Figure 3:
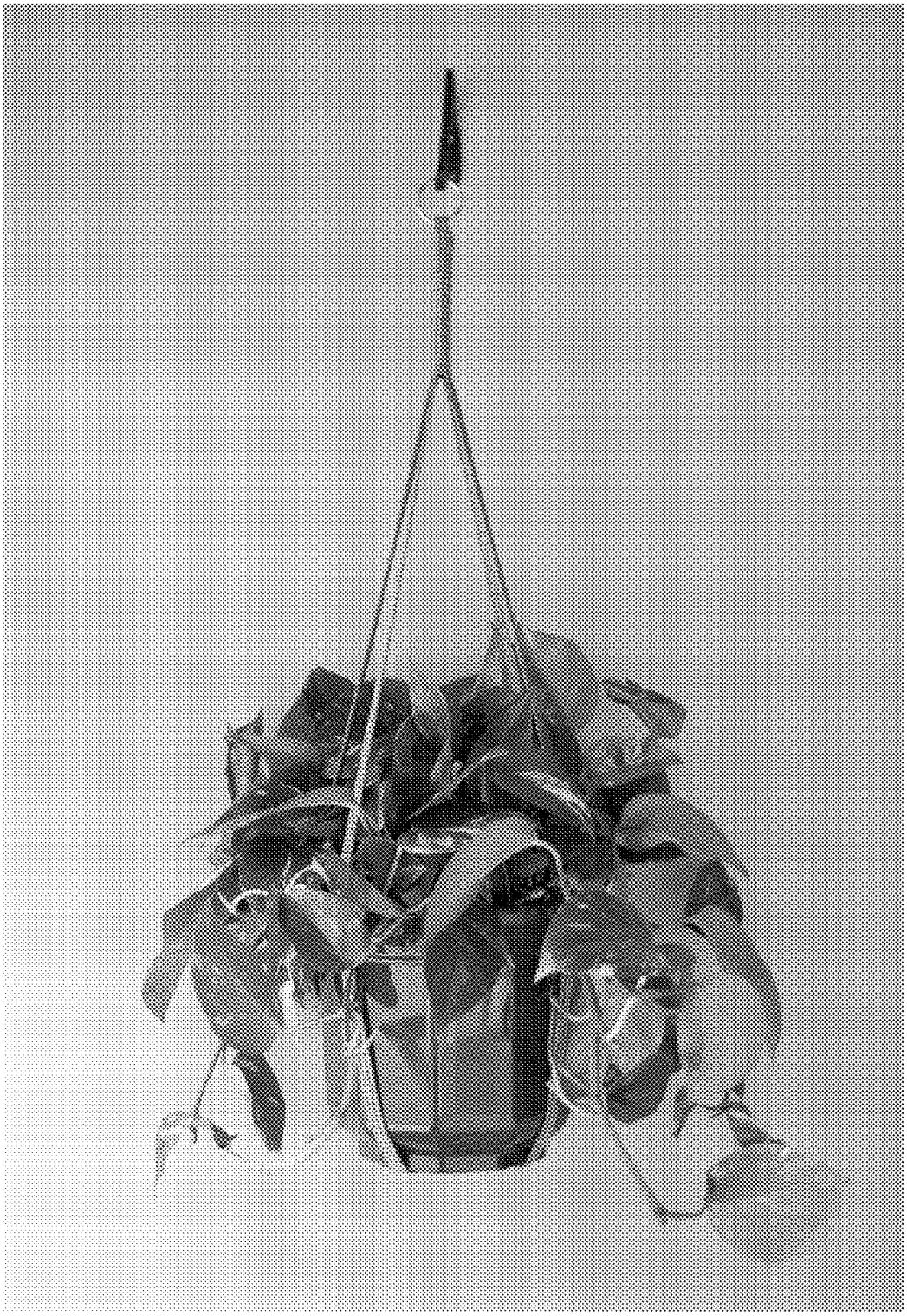
FIG. 3 shows the novel plant hanger with a pot held therein.

In FIG. 1 is shown the novel plant hanger 9 with no pot held within. Hanger 9 comprises two looped straps 10 and 11 in which the upper portion of each of which pass through manually through the adjustable element or sleeve 14 and through top ring 13 without being tied or otherwise attached to ring 13. The lower portion of the loop straps 10 and 11 are attached to a spacing element 12 which keep straps 10 and 11 oriented at ninety degrees with respect to each other. Maintaining straps 10 and 11 in this orientation assures that when a pot is hung in plant hanger 9, as shown in FIG. 3, assures that the straps 10 and 11 will be evenly distributed around plant hanger 9 and that a pot held within can't easily fall from plant hanger 9. The straps 10 and 11 can be easily slid through the spacing element 12 when adjusting plant hanger 9 to make a pot level and positioned safely.

The straps 10 and 11 used in the plant hanger 9 are all loops and are not fastened to a top ring 13 of the plant hanger 9 that is used to hang the plant hanger 9 with a plant therein (not shown) from an overhead hook (not shown) as most plant hangers are hung. Rather, the straps loop through top ring and under a pot (not shown) held in plant hanger 9. Each of the loop straps 10 and 11 of plant hanger 9 can easily be slid through the top ring 13, and the manually adjustable element 14 can be slid up and down to level pot held in plant hanger 9.

Double headed arrow A in FIG. 1 indicates how the manually adjustable element or sleeve 14 can slide along loop straps 10 and 11 from adjacent to ring 13 and toward spacing element 12. Typically, when a large pot (not shown) is held in straps 10 and 11 of plant hanger 9 the manually adjustable element or sleeve 14 will normally be positioned closer to ring 13. When a small pot (not shown) is held in straps 10 and 11 of plant hanger 9, the manually adjustable element or sleeve 14 will normally be positioned further from ring 13 to assure that straps 10 and 11 will secure the positioning of the small pot safely held in hanger 9.

Plant hanger 9 is typically hung by way of a sturdy ring 13 to an overhead hook (not shown) as is well known in the art.

The manually adjustable element or sleeve 14 does not slide loosely along looped straps 10 and 11. There is enough friction so that when adjustable element or sleeve 14 is adjusted to a position along straps 10 and 11 it will remain in that position.

Figure 2:
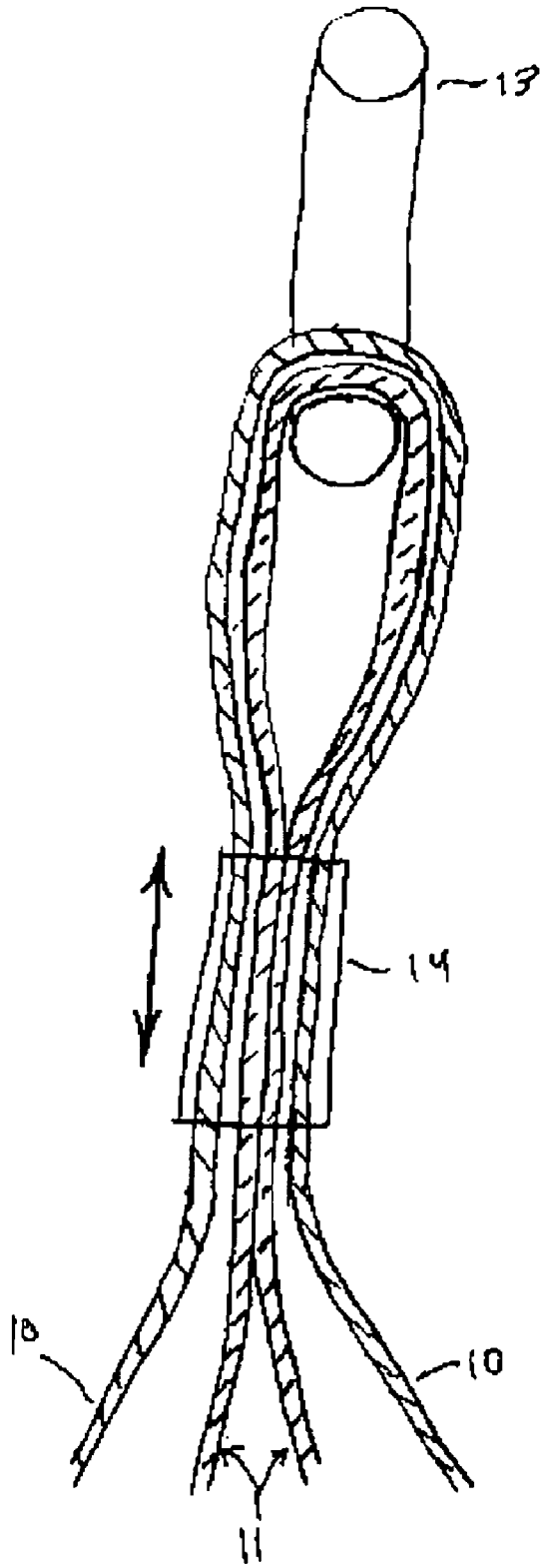
FIG. 2 shows the top of the novel plant hanger with the loop straps passing through the ring and showing how the manually adjustable element or sleeve can slide along the loop straps.

FIG. 2 shows the top portion of the novel plant hanger 9 with the loop straps 10 and 11 passing through the sturdy ring 13 and showing how the manually adjustable element or sleeve 14 can slide up and down along the looped straps 10 and 11 as indicated by the double headed arrow. In this Figure it can be more easily seen that straps 10 and 11 are not tied or otherwise fastened to ring 13 but, rather pass loosely through ring 13, allowing the hanger to be adjusted to level pot.

In FIG. 2 it can also easily be seen that straps 10 and 11 pass through adjustable element or sleeve 14 and are not attached or otherwise fastened thereto. This permits straps 10 and 11 to be individually slid with respect to each other through ring 13 and sleeve 14. This is done to level any shaped pots that are hung in plant hanger 9.

In FIG. 3 is shown the novel plant hanger with a pot held therein.

Mechanical features of novel plant hanger have been described thus far. However, the colors and/or patterns on straps 10 and 11 and adjustable element or sleeve 14 may be varied to meet the taste of individual users. Unlike prior plant hangers, there are no sea shells or tassels used to dress up the straps. Other plant hangers (straps 10 and 11) may actually be made out of cords, macramé, rope, yarn, wire, or chains. The present invention straps 10 and 11 are made from folded sturdy fabric or cloth material with filler (located on the inside of the straps 10 and 11 for extra safety and security) that may be comprised of plastic or vinyl. Adjustable element or sleeve 14 is made of cloth, fabric, or a decorative wire or bead. The present plant hanger 9 can use any sort of fabric or material which will allow the manufacturer to use different colors and patterns to cater to a broad audience's color themes and home decor. By using filler inside of the cloth/fabric straps 10 and 11 allows longer product life expectancy compared to other plant hangers. Prior hangers using cords, macramé, rope and yarn are prone to dry rot over time due to sunlight and other weather conditions, which may slowly deteriorate hanger's straps and the safety of the hanger.

While what has been described above is the preferred embodiment of the invention it will be understood by those skilled of the art that numerous changes may be made without departing from the spirit and scope of the invention.

The invention claimed is:

1. An adjustable plant hanger for hanging a container with a plant therein via a ring that is part of the plant hanger from a support surface or hook, the plant hanger comprising:

a plurality of elongated members that support the container in the plant hanger, the elongated members each being in the form of a continuous loop that passes through the ring; and a manually adjustable element through which the elongated members pass, and the adjustable element is slideable along the elongated members to adjust the plant hanger to hold different sized containers.

2. The hanging plant hanger of claim 1 further comprising a support element through which the elongated members loosely pass, the support element being positioned underneath a container held in the plant hanger to maintain an angle with respect to each other at which the elongated members cross each other underneath and alongside the container held in the plant hanger to better hold the container in the plant hanger.

3. The hanging plant support of claim 2 wherein the elongated members in the form of loops that pass through the ring, the manually adjustable element and the support member can slide relative to each other to level a container supported in the plant support.

4. The hanging plant hanger of claim 1 further comprising a support element through which the elongated members loosely pass, the support element and being positioned underneath a container held in the plant hanger to maintain an angle with respect to each other at which the elongated members cross each other underneath and alongside the container held in the plant hanger to better hold the container in the plant hanger.

5. The hanging plant support of claim 4 wherein the elongated members in the form of continuous loops that pass through the ring and support element can slide relative to each other to level a container supported in the plant support.

6. The hanging plant support of claim 1 further comprising means for keeping the plurality of elongated members separated from each other so that the container is properly supported in the plant support.

7. The hanging plant support of claim 1 wherein the elongated members in the form of continuous loops that pass through the ring can slide relative to each other to level a container supported in the plant support.

* * * * *